US005305484A

United States Patent [19]

Fitzpatrick et al.

[11] Patent Number: 5,305,484

[45] Date of Patent: Apr. 26, 1994

[54] CLOTHES STEAMING AND DRYING CABINET

[75] Inventors: John S. Fitzpatrick, County Cork; Patrick M. Branigan, Dublin; William C. Kee, County Dublin; Cornelius B. Clarke, Dublin; Ernest Search, County Dublin; Mark Cunnane, Dublin; Richard P. Delaney, County Dublin, all of Ireland

[73] Assignee: J.S.F. Holdings (Cork) Limited, County Cork, Ireland

[21] Appl. No.: 891,690

[22] Filed: Jun. 1, 1992

Related U.S. Application Data

[63] Continuation of Ser. No. 790,144, Nov. 7, 1991, abandoned, which is a continuation of Ser. No. 631,766, Dec. 21, 1990, abandoned, which is a continuation of Ser. No. 463,893, Jan. 9, 1990, abandoned, which is a continuation of Ser. No. 295,853, Jan. 11, 1989, abandoned.

[30] Foreign Application Priority Data

Jan. 13, 1988 [IE] Ireland ..... 79/88
May 24, 1988 [IE] Ireland ..... 1558/88

[51] Int. Cl.[5] ..... D06B 1/08

[52] U.S. Cl. ..... 8/149.3; 68/5 C; 68/6; 223/70

[58] Field of Search ..... 223/51, 70, 73, 76; 18/58, 6; 8/149.2, 149.3

[56] References Cited

U.S. PATENT DOCUMENTS 1,453,967 5/1923 Angelus ..... 68/56
1,817,590 8/1931 Simon ..... 68/6 X
2,378,565 6/1945 Locke et al. ..... 223/70 X
2,443,069 6/1948 Gayring ..... 68/5 C
3,157,475 11/1964 Stainbrook .
3,475,828 11/1969 Feldman .
3,670,425 6/1972 Benjamin et al. .
3,712,086 1/1973 Payet et al. ..... 68/5 C
3,805,561 4/1974 Bullock .
3,849,815 11/1974 Frauendorf ..... 68/5 C X
3,861,179 1/1975 Ochard ..... 68/6
4,304,053 12/1981 Kellerhals et al. ..... 68/5 C

FOREIGN PATENT DOCUMENTS 2252244 9/1974 Fed. Rep. of Germany .
2433909 5/1976 Fed. Rep. of Germany .
2220613 4/1974 France .
2402732 6/1979 France .
1414041 12/1975 United Kingdom .
1604748 12/1981 United Kingdom .

*Primary Examiner*—Frankie L. Stinson
*Attorney, Agent, or Firm*—Thomas A. Gallagher

[57] ABSTRACT

A clothes steaming and drying cabinet comprising a housing defining an interior region for the clothes. Hangers and a bar are provided for suspending jackets and trousers respectively. Weighted bars tension the clothes during steaming. A sub housing houses a heating element and a fan for delivering heated air into the interior region. A boiler tank generates steam for delivery into the region. During the steaming and drying cycle, steam is delivered for a steaming period of the cycle and subsequently heated air is delivered during the drying period of the cycle. During the steaming period, heated air is intermittently delivered into the interior region simultaneously with the steam to reduce the formation of condensation on the interior of the cabinet.

11 Claims, 8 Drawing Sheets

CLOTHES STEAMING AND DRYING CABINET

This is a continuation of application Ser. No. 790,144 filed Nov. 7, 1991, now abandoned which in turn is a continuation of application Ser. No. 631,766 filed Dec. 21, 1990, now abandoned, which in turn is a continuation of application Ser. No. 463,893 filed Jan. 9, 1990, now abandoned, which in turn is a continuation of application Ser. No. 295,853 filed Jan. 11, 1989, now abandoned.

FIELD OF THE INVENTION

The present invention relates to a clothes steaming and drying cabinet, and in particular but not limited to a steaming and drying cabinet for steaming and drying clothes, such as for example, jackets, trousers, blouses, skirts and the like.

BACKGROUND OF THE INVENTION

Clothes steaming and drying cabinets for steaming and drying jackets, trousers, blouses, skirts and the like are known, U.S. Pat. No. 3,752,373 discloses such a cabinet. These cabinets are normally used for steaming clothes to remove wrinkles and the like and also for drying and airing the clothes after the wrinkles have been removed. Indeed, in certain cases, the cabinets are used for drying and airing clothes only, in which case the steaming period of the cycle would not be used.

The cabinet disclosed in U.S. Pat. No. 3,752,373 comprises a housing of flexible material which may be folded up for carrying. The housing defines an interior region for hanging clothes, and a boiler for generating steam is mounted in a lower region of the housing beneath the interior region. Steam is delivered from the boiler into the interior region of the housing to steam the clothes. A motor driven fan and electrically powered heating element are also provided in the lower portion of the housing for delivering heated air into the interior region for drying and airing the clothes. This cabinet, like other similar types of cabinets, suffers from a number of serious disadvantages. Firstly, the steam tends to condense on the inner surfaces of the walls of the cabinet and when sufficient steam has condensed, droplets form which drop onto the clothes, causing serious water mark staining. In fact, it is believed that it is impossible to achieve adequate steaming of the clothes in the cabinet of U.S. Pat. No. 3,752,373 without condensation drops forming water marks on the clothes.

A second disadvantage of the cabinet of U.S. Pat. No. 3,752,373 and indeed other such cabinets is that even with the application of steam to the garments, it is virtually impossible to remove all the wrinkles. This is particularly so in certain fabrics where the frictional resistance of the fibres is such as to resist relative movement of the fibres even with steaming. No suitable steaming apparatus has so far been provided which can remove wrinkles from fabrics where there is a relatively high degree of friction between the fibres.

There is therefore a need for a clothes steaming and drying cabinet which overcomes the problems of known cabinets.

OBJECTS OF THE INVENTION

One object of the invention is to provide a clothes steaming and drying cabinet for relatively effectively and efficiently removing wrinkles from clothes. Another object of the invention is to provide a clothes steaming and drying cabinet in which the level of condensation forming on the interior surface of the cabinet is maintained at a level where water droplets do not form, or if they do form, they are maintained at a sufficiently small size so as not to drop onto clothes being steamed in the cabinet. Another object of the invention is to provide a clothes steaming and drying cabinet in which the energy requirements of the cabinet are relatively low. A further object of the invention is to provide a clothes steaming and drying cabinet which is relatively inexpensive to produce, and relatively efficient to run and relatively easy to operate. A further object of the invention is to provide a clothes steaming and drying cabinet, wherein in certain cases the cabinet may be used for drying hair or other parts of the body as desired. A further object of the invention is to provide a clothes steaming cabinet for steaming clothes in which the level of condensation formed on the interior surface of the cabinet is maintained at a level at which water droplets do not form, and where they do form, they are of sufficiently small size as not to drop onto the clothes being steamed. Another object of the invention is to provide a drying cabinet in which the energy requirements are relatively low.

SUMMARY OF THE INVENTION

According to the invention, there is provided a clothes steaming and drying cabinet comprising a main housing defining an enclosed interior region for receiving clothes, steam delivery means for delivering steam into the interior region during a steaming and drying cycle, air delivery means for delivering heated air into the interior region during the steaming and drying cycle, and control means for controlling the steam delivery means and the air delivery means so that heated air is delivered into the interior region simultaneously with the steam during portion of a steaming period of the cycle.

In one embodiment of the invention, the heated air is intermittently delivered simultaneously with the steam into the interior region for at least 10% of the steaming period of the cycle.

In another embodiment of the invention, tensioning means for tensioning a garment is provided in the interior region.

In a further embodiment of the invention, the tensioning means is provided by a weight member having clip means attached thereto for releasably connecting the weight member to the garment.

In a further embodiment of the invention, recirculating means are provided for recirculating some of the heated air and steam from an outlet from the interior region into an inlet to the interior region, a make up air inlet communicating with atmosphere for providing make up air to the interior region.

In another embodiment of the invention, the recirculating means comprises a duct extending from the outlet from the interior region, an exhaust outlet in the duct communicating with atmosphere for exhausting some of the heated air and steam to atmosphere, the interior region outlet and the exhaust outlet being substantially opposite each other, the ratio of the effective area of the interior region outlet to that of the exhaust outlet being at least 1.5:1.

Additionally, the invention provides a method for steaming and drying a garment in the cabinet of the invention, the method comprising the steps of delivering steam into the interior region of the cabinet during a steaming and drying cycle, delivering heated air into the interior region of the cabinet during the steaming and drying cycle, wherein the heated air is delivered into the interior region simultaneously with the steam during portion of a steaming period of the steaming and drying cycle.

Advantageously, the steaming and drying cycle comprises the steaming period and a drying period, the steaming period being at least 20% of the total steaming and drying cycle time and the drying period being at least 20% of the total steaming and drying cycle time.

Further, the invention provides a clothes steaming and drying cabinet comprising a main housing defining an enclosed interior region for receiving clothes, steam delivery means for delivering steam into the interior region during a steaming and drying cycle, air delivery means for delivering heated air into the interior region during the steaming and drying cycle, control means for controlling the steam delivery means and air delivery means, and tensioning means for tensioning a garment being provided in the interior region.

Further, the invention provides a clothes steaming and drying cabinet comprising a main housing defining an enclosed interior region for receiving clothes, steam delivery means for delivering steam into the interior region during a steaming and drying cycle, air delivery means for delivering heated air into the interior region during the steaming and drying cycle, control means for controlling the steam delivery means and air delivery means, and means for delivering heated air through a nozzle mounted externally of the housing for drying hair and the like being provided.

Additionally, the invention provides a clothes steaming cabinet comprising a main housing defining an enclosed interior region for receiving clothes, steam delivery means for delivering steam into the interior region during a steaming period of a steaming cycle, wherein air delivery means are provided for delivering heated air into the interior region simultaneously with the steam during portion of a steaming period of the steaming cycle.

The invention also provides a clothes drying cabinet comprising a main housing defining an enclosed interior region for receiving clothes, air delivery means for delivering heated air into the interior region during a drying period of a drying cycle, and recirculating means for recirculating some of the heated air and steam from an outlet from the interior region into an inlet to the interior region, a make up air inlet communicating with atmosphere for providing make up air to the interior region wherein the recirculating means comprises a duct extending from the outlet from the interior region, an exhaust outlet in the duct communicating with atmosphere for exhausting some of the heated air and steam and/or moisture to atmosphere, the interior region outlet and the exhaust outlet being substantially opposite each other, the ratio of the effective area of the interior region outlet to that of the exhaust outlet being at least 1.5:1.

ADVANTAGES OF THE INVENTION

The advantages of the invention are many, however, a particularly important advantage provided by the invention is that the formation of condensation on the inner surface of the interior region of the cabinet is retained to a minimum. The condensation is retained to a level that the formation of water droplets on the inner surface of the interior region is avoided. This avoids the danger of water mark stains on the clothes in the airing cabinet, which as already discussed, are commonly caused by drops of condensation dropping onto the clothes in prior art cabinets. This advantage is achieved by the fact that heated air is simultaneously delivered into the interior region with the steam for portion of the steaming period.

It has been found that to get the best effects of the steam, it is important to keep the period of time during which heated air is delivered into the interior region simultaneously with the steam as low as possible. It has been found that the introduction of heated air with the steam tends to reduce the effectiveness of the steam in removing wrinkles from the clothes. Indeed, steam is most effective in removing wrinkles when used without heated air. However, on the other hand, when heated air is not introduced with the steam, the level of condensation formed by the steam on the inner surface of the interior region is unacceptable. It has been found that once the air is introduced into the interior region simultaneously with the steam for at least 10% of the steaming period of the cycle condensation is kept to a level where droplets do not form. Furthermore, it has been found that the effect of this amount of heated air does not to any great extent reduce the effectiveness of the steam in removing wrinkles. However, it has been found that optimum results are achieved when the heated air is introduced simultaneously with the steam for approximately 40% of the steaming period of the cycle. It has been found that where the heated air is introduced for 40% of the steaming period very little condensation is formed, and there is virtually no danger of the condensation forming into droplets. Further, it has been found that the effectiveness of the steam in removing wrinkles is not unduly affected. In fact, it has been found that good results are achieved when the heated air is introduced into the interior region simultaneously with the steam for a period in the range of 35% to 45% of the steaming period.

Indeed, it has been found that better results are achieved when the heated air is introduced intermittently during the steaming period. By intermittently introducing heated air, the effectiveness of the steam in removing wrinkles is even less impaired and condensation is held to a more preferred level.

The advantage of providing tensioning means is that it considerably improves the removal of wrinkles from garments. Further, in the case of trousers, it also may facilitate in forming a crease in the trousers. It has also been found that tensioning the clothes during the steaming period permits heated air to be introduced into the interior region for a longer period of time during the steaming period without unduly reducing the effectiveness been found that particularly good results are achieved when the heated air is introduced for a period of time in the range of 35% to 45% of the steaming period when the clothes are put in tension.

It is believed that by placing the clothes in tension the fibres of the clothes are forced to move over each other during the steaming period. Once the fibres have moved relative to each other and are relaxed by the steam, they do not revert to their original position causing the wrinkles. In fact, it is believed that tensioning clothes during the steaming period considerably enhances the removal of wrinkles from garments manufactured from fibres which have relatively high relative friction resistance to movement relative to each other.

Where recirculating means are provided, the energy requirements of the cabinet are reduced. However, in general, it has been found that the main advantage of providing air recirculating means is achieved during the drying period of the steaming and drying cycle. It has been found that by keeping the ratio of the effective area of the interior region outlet to that of the exhaust outlet at or above 1.5:1 more of the moisture removed from the clothes during the drying cycle is exhausted to atmosphere than is recirculated. Accordingly, the air being recirculated has the capacity to remove further moisture from the clothes on being recirculated. When the ratio of the areas of the two openings is 2:1 approximately 50% of the air passing through the outlet opening from the interior region is exhausted to atmosphere through the exhaust opening and the remaining 50% which is considered less moisture laden air is recirculated.

It is not known exactly what proportion of the moisture is exhausted and what proportion is recirculated. However, it has been found that with the area ratio at 2:1, the amount of moisture delivered into the air is approximately 250 gms per hour, this is substantially similar to the quantity of moisture which an individual discharges into the air as a result of normal breathing. This is a particularly important advantage in that the level of moisture discharged into the atmosphere during the drying period of the steaming and drying cycle being similar to that discharged by a normal human being causes very little condensation in a room in which the cabinet is used.

The advantage of providing a nozzle mounted externally of the housing for drying hair and the like is that it permits the cabinet to be used for hair drying or drying any other part of the body.

These and other objects and advantages of the invention will be readily apparent from the following description of a preferred embodiment thereof, given by way of example only, with reference to the accompanying drawings.

DETAILED DESCRIPTION OF THE INVENTION

Figure 1:
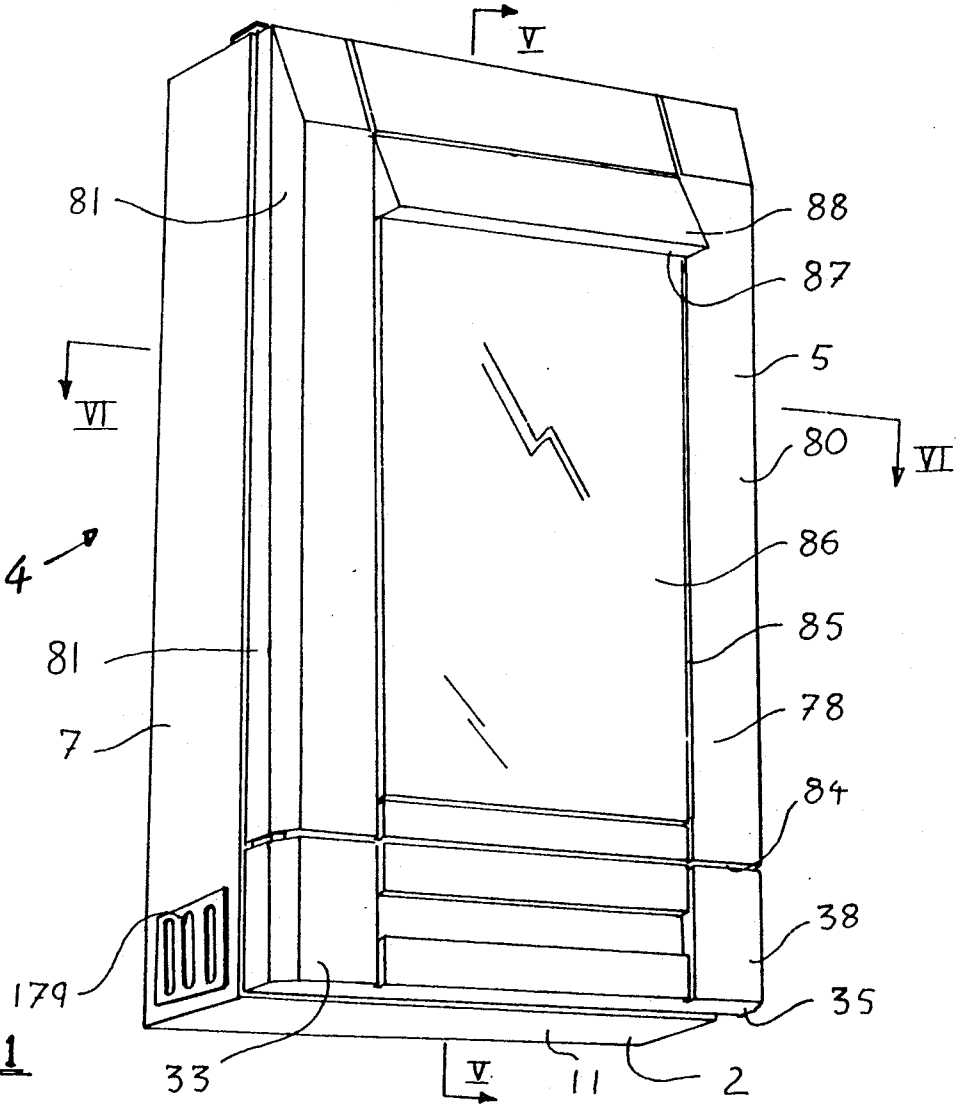
FIG. 1 is a front perspective view of a clothes steaming and drying cabinet according to the invention.
Figure 2:
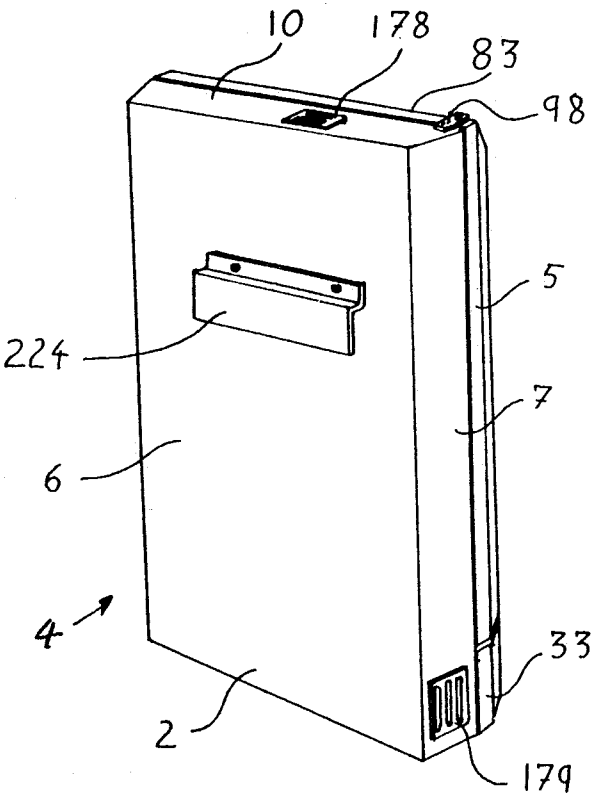
FIG. 2 is a rear perspective view of the cabinet of FIG. 1.
Figure 3:
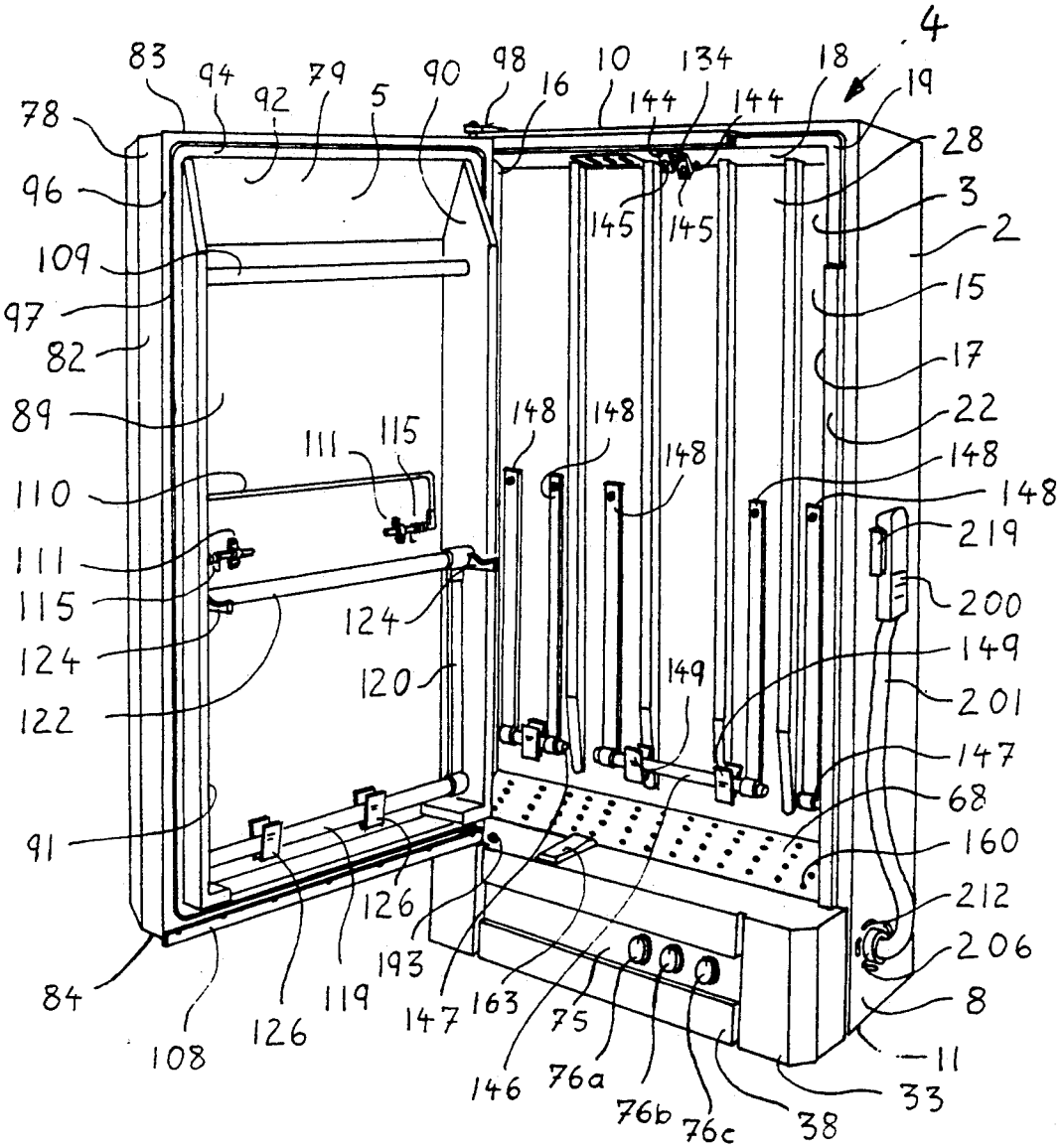
FIG. 3 is a perspective view of the cabinet of FIG. 1 with a door open.

Referring to the drawings, there is illustrated a clothes steaming and drying cabinet according to the invention indicated generally by the reference numeral 1 for steaming and drying clothes, in particular for steaming clothes to remove wrinkles and then subsequently drying the clothes. The cabinet 1 comprises a main housing 4 formed by an outer skin 2 and an inner skin 3. A door 5 of the main housing 4 is also formed by an outer skin 78 and an inner skin 79. The inner skins 3 and 79 define an interior region 28 for receiving the clothes to be steamed and dried. The outer skin 2 is of sheet metal and comprises a rear wall 6, a pair of side walls 7 and 8, and top and bottom walls 10 and 11 all extending from the rear wall 6. The inner skin is of plastics material formed by a vacuum forming process and comprises a rear wall 15, side walls 16 and 17 and a top wall 18. Lips 19 extending sidewardly from the periphery of the side walls 16 and 17 and the top wall 18 around the periphery of the inner skin engage corresponding lips 20 which extend from the side walls 7 and 8 and top wall 9 of the outer skin 2. A recess 21 is formed in the lips 20 to receive the lips 19. Screws (not shown) secure the lips 19 and 20 together. A sealing gasket 22 to seal against the door 5 is retained between the lips 19 and 20. The gasket 22 also acts to seal between the lips 19 and 20.

The side walls 7 and 8 of the outer skin 2 are spaced apart from the side walls 16 and 17 of the inner skin as are the top walls 9 and 18. Portion of the space 25 between the top walls 9 and 18 and the side walls 7 and 16 forms a duct 26 for a purpose described below. A sheet 27 of heat insulating material, namely expanded polystyrene is sandwiched between the rear wall 6 and the rear wall 15 of the outer skin 2 and inner skin 3 respectively, and acts to seal the gap between the two rear walls 6 and 15, thus forming a sealed duct 26. Ridges 24 are formed in the rear wall 15 to facilitate air and steam circulation between the clothes and the rear wall 15.

A sub housing 33 is releasably mounted in a lower portion 34 of the outer skin 2 and carries means for generating steam and means for generating heated air, both for delivery into the interior region 28, as will be described below. The sub housing 33 is of sheet metal and comprises a base 35, a pair of side walls 36 and 37 and a front wall 38 and a rear wall 39. A top wall 40 extends between the front and rear walls 38 and 39 and the side walls 36 and 37. The rear wall 39 and portion base 35 are formed by a single sheet metal sheet 41 bent at 42. The front wall and remaining portion of the base as well as portion of the top wall 40 are formed by a single sheet of sheet metal 44 bent at corners 45. Lips 43 and 51 are provided on the sheets 41 and 42 respectively for spot welding the sheets 41 and 42 together.

The remaining portion of the top wall 40 is formed by a sheet metal tray 46 having a base 47, side walls 48 and front and rear walls 49 and 50. The tray 46 collects drips of moisture as will be described below during the steaming and drying cycle. The end walls 36 and 37 are formed by end caps which close the interior region 53 formed by the sub housing 33. A portion of the lips 20 of the outer skin 2 adjacent each side of the sub housing 33 are bent outwardly at 55. Holes 56 accommodate screws (not shown) to engage threaded holes 57 in lips 58 extending from the side walls 36 and 37 for securing the sub housing 33 in the lower portion 34 of the outer skin 2. A runner 60 of plastics material of U-shaped cross section tightly engages a lip 61 extending upwardly from the bottom wall 10 of the outer skin 2 to slidably support the base 35 of the sub housing 33 to facilitate removal and replacement of the sub housing 33.

Brackets 66 extending upwardly from the tray 46 support a base member 68 of perforated sheet metal material at the end of the interior region 28. Screws (not shown) secure the base member 68 to brackets 66. A step 73 at the lower ends of the side walls 16 and 17 and rear wall 15 of the inner skin 3 also supports the base member 68.

A recess 75 is formed in the front wall 38 of the sub housing 33 to accommodate knob operated switches 76*a*, 76*b* and 76*c* for switching on and off and controlling the cycle of the cabinet, as will be described below.

Before dealing further with the components mounted in the sub housing 33, the door 5 will first be described. The door 5 as already described is formed by an outer skin 78 and an inner skin 79. The outer skin 78 is of sheet metal material and comprises a front wall 80, side walls 81 and 82 and top and bottom walls 83 and 84 respectively. A recess 85 is provided in the front wall 80 to carry a mirror 86. A strip light 87 is mounted on the door at 88. The inner skin 79 is of vacuum formed plastics material and comprises a front wall 89, side walls 90 and 91 and top and bottom walls 92 and 93 respectively. A lip 94 extending outwardly from the side walls 90 and 91 and top and bottom walls 92 and 93 around the periphery of the inner skin 79 engages a corresponding lip 96 extending from the side walls 81 and 82 and top and bottom walls 83 and 84 around the periphery of the outer skin 78. A recess 97 is formed in the lip 96 to receive the lip 94. Screws (not shown) secure the lips 94 and 96 together. The lips 94 and 96 and recess 97 are similar to the lips 19 and 20 and the recess 21 respectively. Hinge brackets 98 and 99 extend from the top wall 9 and the side wall 7 respectively of the outer skin 2 to hingedly support the door 5. Pivot pins 100 on the hinge brackets 98 and 99 pivotally engage pivot holes (not shown) in the top and bottom walls 83 and 84 of the outer skin 78 of the door 5.

A sealing gasket 108 of flexible plastics material extends downwardly of the door 5 from the lip 96 along the bottom wall 84 and engages the top wall 40 of the sub housing 33. A magnetic catch (not shown) in the seal 22 retains the door 5 closed.

Figure 4:
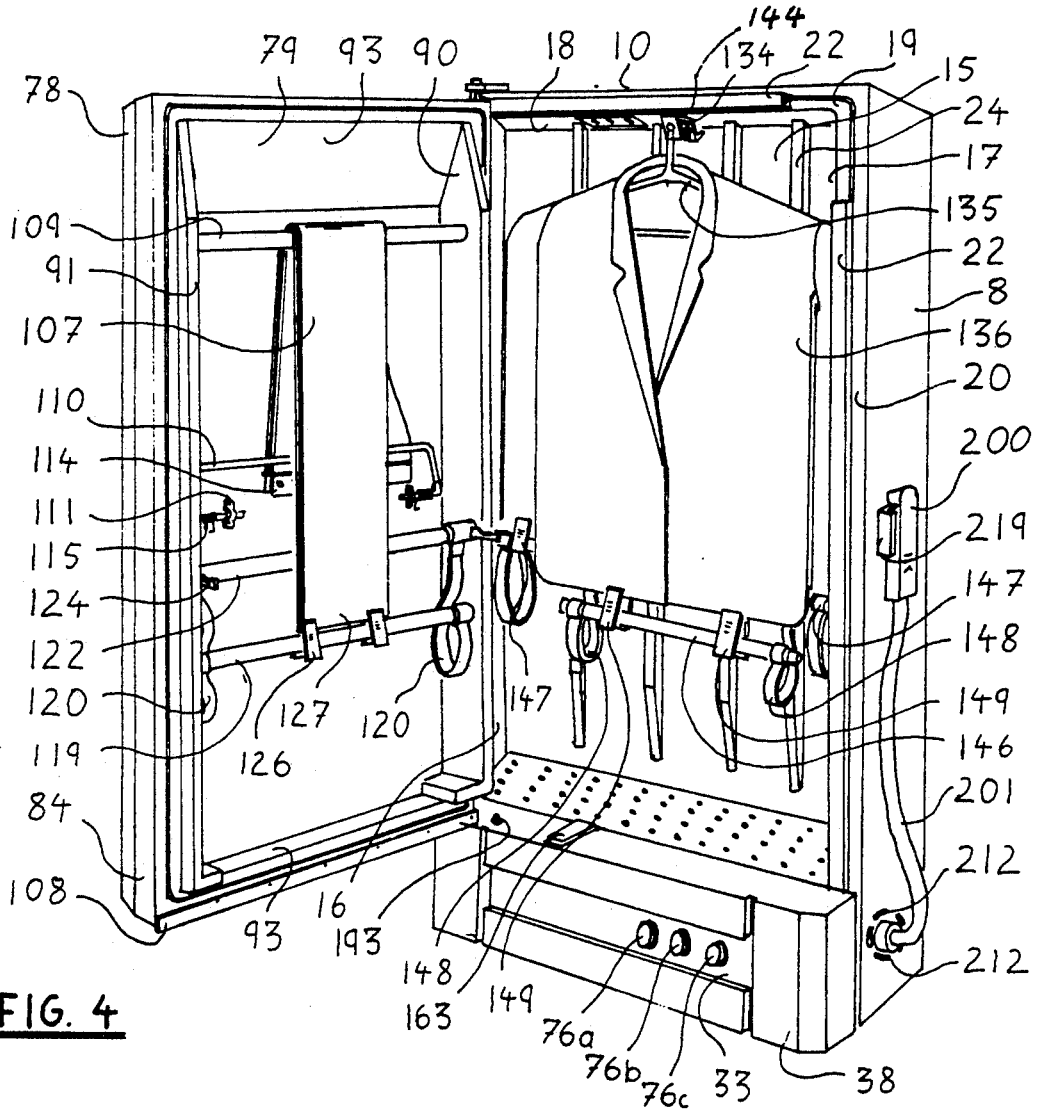
FIG. 4 is a perspective view of the cabinet of FIG. 1 in use.
Figure 8:
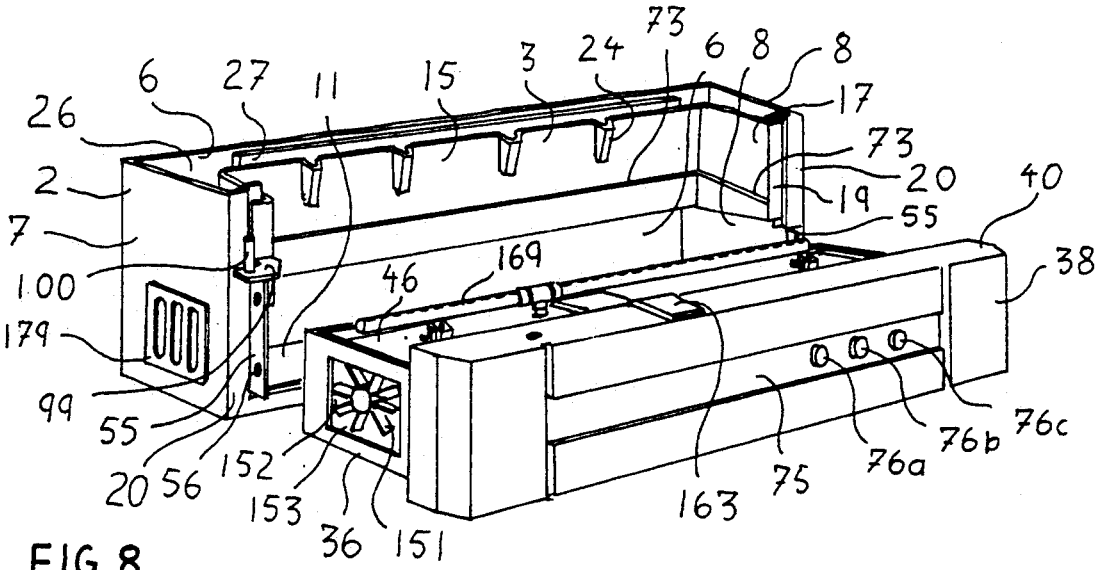
FIG. 8 is a perspective view of the detail of FIG. 7 from a different direction.

A tubular steel bar 109 extends between the side walls 90 and 91 of the inner skin 79 of the door 5 for supporting garments to be dried, in particular for supporting a trousers 107, see FIG. 4. A clamp bar 110 pivotal in brackets 111 clamps the waist 114 of the trousers 107 against the front wall 89 of the inner skin 79 of the door 30. Springs 115 bias the clamp bar 110 against the front wall 89. Tensioning means for applying tension to the trousers during steaming as will be described below comprises a weight member, namely, a tubular steel bar 119 which is anchored to the door 5 by webbing straps 120. The webbing straps 120 depend from a bar 122 extending between the side wall 90 and 91. Lead shot (not shown) is provided in the bore of the tubular bar 119 to increase its weight for tensioning purposes. End caps (not shown) close the bore of the bar 119. Spring biased clips 126 secure the bar 119 to the trouser legs 127 as illustrated in FIG. 4. Thus, when the trousers 107 are clamped by their waist 114 by the clamp bar 110 and the weighted bar 119 is connected to the legs 127 the trousers are put in tension around the bar 109. A pair of hooks 124 are secured on the bar 122 for supporting the weighted bar 119 while it is being attached to the trouser legs.

A bracket 134 mounted on the top wall 9 of the inner skin 3 receives two coat hangers 135 for hanging garments such as a jacket 136 as illustrated in FIG. 4. The bracket 134 comprises cranked portions 144 with keyhole slots 145 to receive ball ends (not shown) of the hangers 135. A reinforcing bracket 138 mounted to the outer and inner skins 2 and 3 supports the bracket 134. Tensioning means for tensioning the jacket 136 during steaming, as will be described below, are provided by tubular bars 146 and 147 which are similar to the bar 119. The bars 146 and 147 also comprising lead shot are anchored to the inner skin 3 of the cabinet 1 by straps 148 of webbing. Clips 149 similar to the clips 126 secure the bars 146 and 147 to the bottom edges of the jacket 136 and sleeves as illustrated in FIG. 4.

In this case, the weight of the bars 119, 146 and 147 including the lead shot is 1 kg, 0.5 kg and 0.25 kg respectively.

Returning now to the sub housing 33, air delivery means for delivering heated air into the interior region is provided in the sub housing 33 by an electrically powered heating element 150 and an electrically powdered motor driven fan 151. The heating element 150 and the fan 151 are mounted in a duct 152 through which the air is delivered in the direction of the arrow A into the interior region 28 of the cabinet 1. The air is received into the fan 151 through an opening 153 in the side wall 36. The source from which the air enters the opening 153 is described below. The air is delivered by the fan 151 across the heating element 150 through an outlet 155 in the duct 152. The outlet 155 is aligned with an opening 156 in a raised portion 157 of the base 47 of the tray 46. Brackets 158 extending upwardly from the raised portion 157 carry a deflecting cowl 159 which forms an annular opening 164 with the raised portion 157 for distributing heated air into the portion of the housing between the tray 46 and the perforated base member 68. The heated air then travels through openings 160 in the perforated base member 68 into the interior region 28.

Steam delivery means for generating and delivering steam into the interior region 28 is provided by a boiler tank 165. Electrically powered immersion heating elements 166 extend into the tank 165 for boiling water and generating steam. An outlet tube 167 from the boiler tank 165 delivers the steam through a T piece 168 into a manifold 169 formed by a pair of tubes 170 extending from the T piece 168. A plurality of outlet holes 172 in the tubes 170 deliver the steam into the area between the tray 46 and the perforated base member 68 from where it is delivered into the interior region 28 through the openings 160 in the perforated base member 68. An inlet tube 162 for filling the boiler tank 165 extends from the tank 165 through the top wall 40 of the sub housing 33. A lid 163 hingedly connected to the top wall 40 closes the inlet tube 162.

The tray 46 is slightly inclined towards an outlet chute 190 for draining away any moisture which may have collected on the tray. A drip collecting tank 191 mounted in the sub housing 33 receives water from the outlet chute 190 through an inlet 189. A valve 192 operated by a rod 193 extending through the tank 191 opens and closes an outlet 194 for draining the tank 191.

Control circuitry in a control box 161 controls the operation of the fan 151 and heating elements 150 and 166 in a sequence described below.

Figure 11:
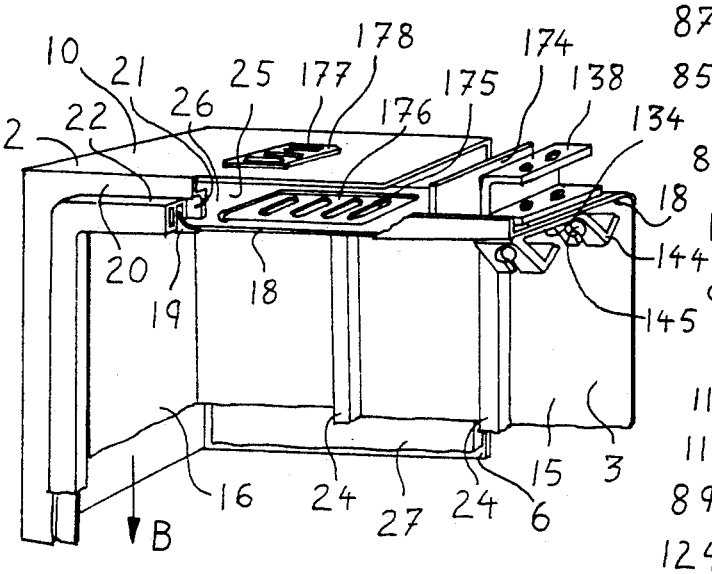
FIG. 11 is an enlarged cut away perspective view of a detail of the cabinet of FIG. 1.
Figure 12:
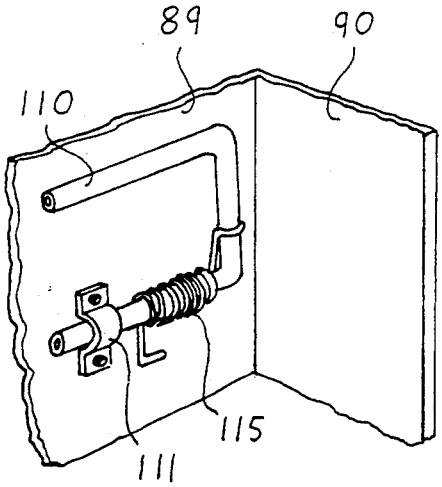
FIG. 12 is an enlarged perspective view of another detail of the cabinet.
Figure 5:
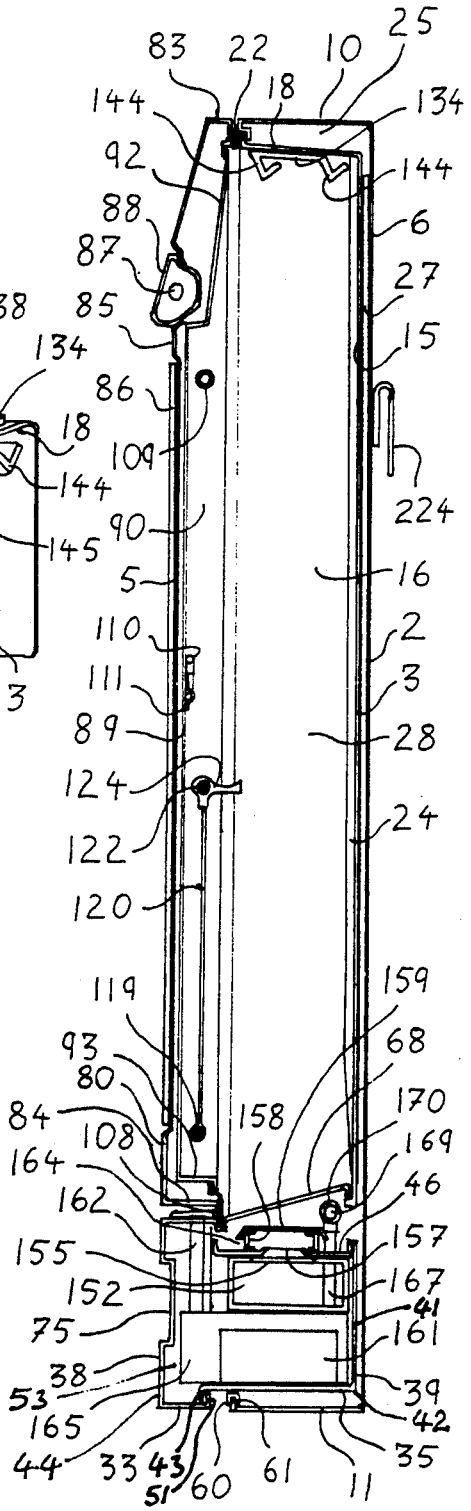
FIG. 5 is a sectional side view of the cabinet on the line V—V of FIG. 1.
Figure 6:
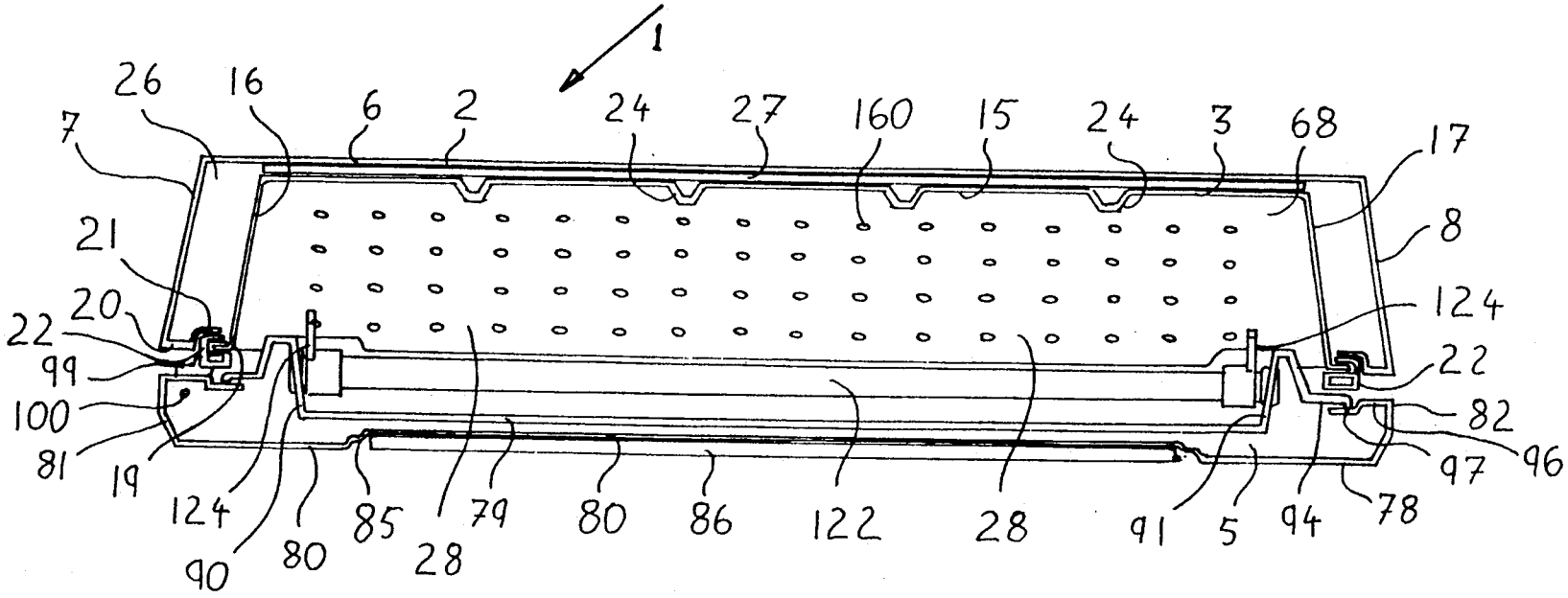
FIG. 6 is a sectional plan view of the cabinet on the line VI—VI of FIG. 1.
Figure 7:
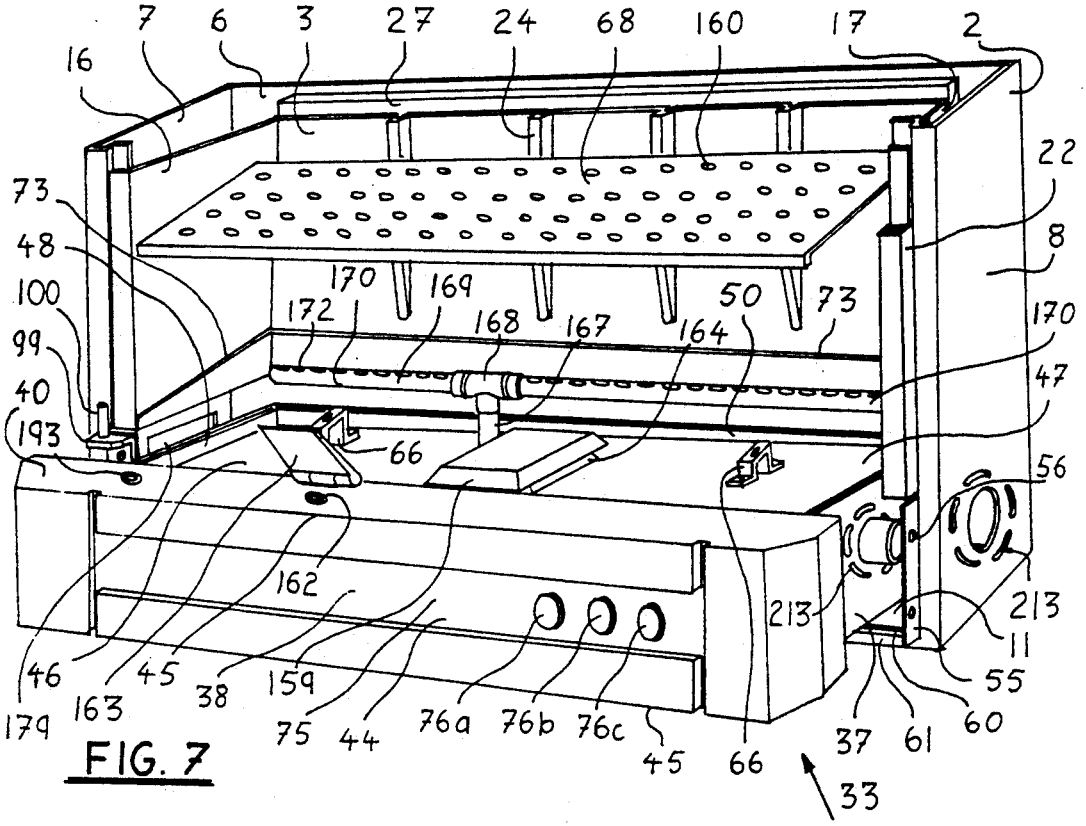
FIG. 7 is a perspective view of a detail of the cabinet of FIG. 1.
Figure 10:
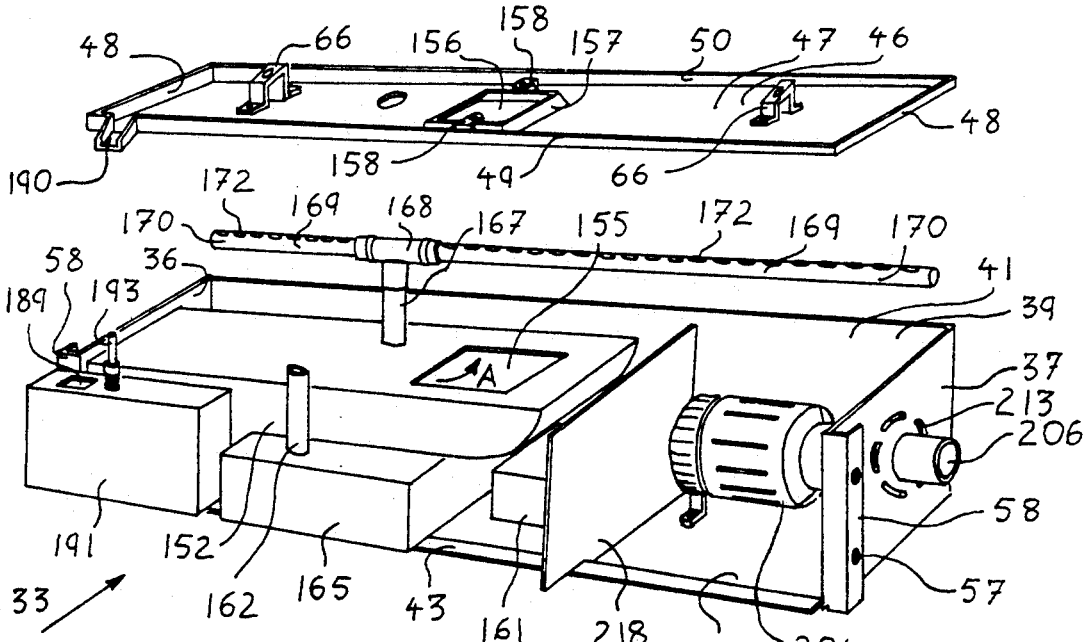
FIG. 10 is a cut away partly exploded view of the detail of FIG. 9.
Figure 9:
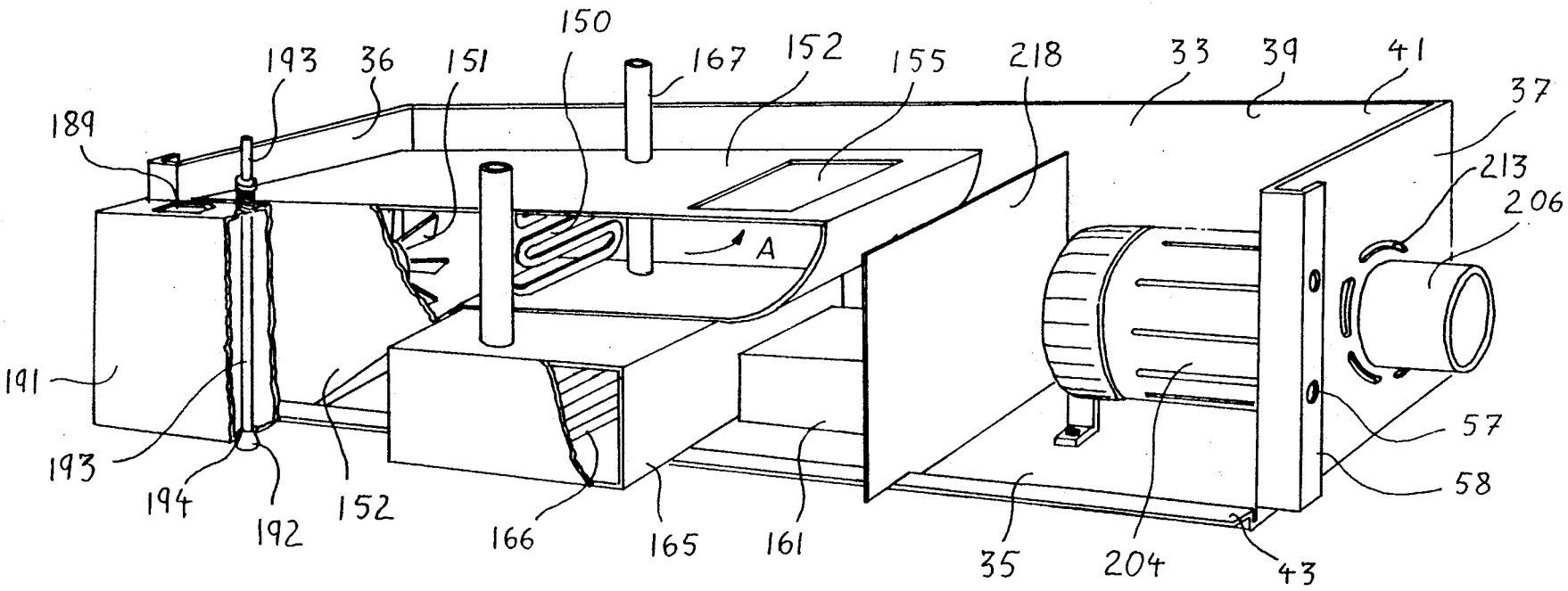
FIG. 9 is a cut away perspective view of portion of the cabinet of FIG. 1.

Returning now to the duct 26, in this case the duct 26 acts as a recirculating means for returning the heated air and some of the steam from the interior region 28 in the direction of the arrow B to the inlet opening 153. A partition wall 174 extending between the top walls 9 and 18 of the outer and inner skin 2 and 3 close off the top end of the duct 26. An outlet opening 175 covered by a grill 176 is provided in the top wall 18 of the inner skin 3 and communicates the interior region 28 with the duct 26. An exhaust outlet opening 177 also covered by a grill 178 in the top wall 9 permits some of the steam and some of the heated air to escape to atmosphere. In this particular case, the openings 175 and 177 are opposite each other and the exhaust opening 177 is arranged to one side of the outlet opening 175 as can be seen in FIG. 11. The effective area of the opening 175 is twice the effective area of the opening 177. It has been found that by having the two openings sized and positioned as illustrated in FIG. 11, a considerable advantage is achieved during the drying period of the cycle. During the drying period when heated air is introduced into the interior region for drying the clothes, as will be described below, moisture removed from the clothes is carried by the heated air through the interior region outlet opening 175. Some of the moisture laden air is recirculated through the duct 26 and some exhausted to atmosphere through the exhaust outlet opening 177. However, it has been found that more of the moisture removed from the clothes during drying is exhausted to atmosphere than is recirculated. This has the significant advantage that the air being recirculated has the capacity to remove further moisture from the clothes on being recirculated. Further, it has been found that by positioning and sizing the openings 175 and 177 as illustrated in FIG. 11, the quantity of moisture discharged into the atmosphere through the outlet opening is, in general, retained at approximately 250 gms per hour, thus avoiding undue condensation in a room in which the cabinet is operating.

The heated air and steam or moisture not exhausted through the opening 177 is delivered through the duct 26 and drawn in through the grill 153 by the fan 151. An inlet grill 179 in the side wall 7 of the outer skin 2 permits make up air to be drawn into the duct 26 and through the grill 153. In this case, the effective area of the inlet grill 179 and the inlet grill 153 are substantially similar.

Figure 13:
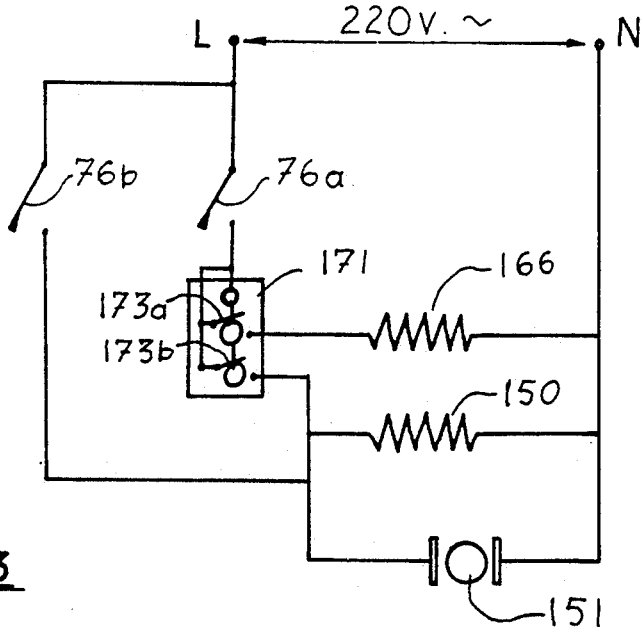
FIG. 13 is a circuit diagram of a control circuit of the cabinet of FIG. 1.

Referring now to FIG. 13 some of the control circuitry in the control box 161 is illustrated. The circuit is fed by a 220 volts AC mains supply. The live of the mains supply is fed through the switch **76*a* to a cam operated timer 171. The heating element 166 of the boiler tank 165 is fed through one cam operated switch 173*a* of the timer 161. The heating element 150 and the motor operated fan 151 for heating the air are fed through a second cam operated switch 173*b* of the timer 171. Should one wish to use the heating element 150 and motor operated fan 151 only to dry clothes, these two components are powered independently through the switch 76*b*. Suitable interlocks (not shown) are provided in the circuit to avoid the two switches 76*a* and 76*b*** being in the on position simultaneously.

Figure 14:
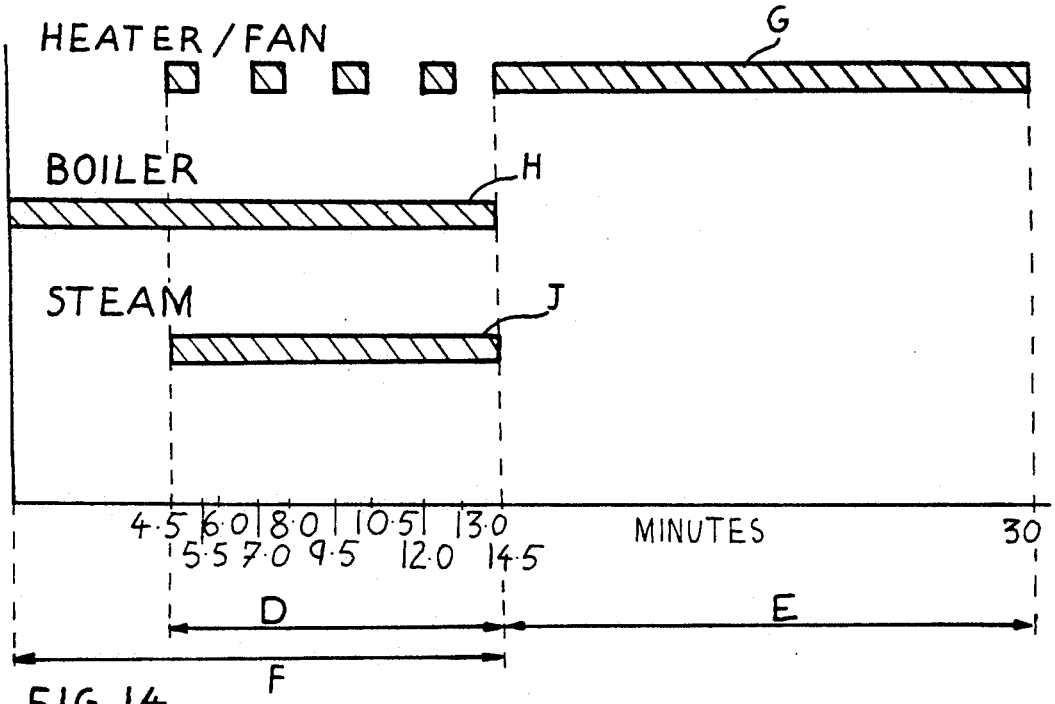
FIG. 14 is a graphical representation of the operation of a steaming and drying cycle of the cabinet of FIG. 1.

Referring now to FIG. 14 the steaming and drying cycle of the cabinet 1 will now be described. The total time of the steaming and drying cycle is thirty minutes. The steaming and drying cycle comprises a steaming period which for convenience has been referred to as the period D and a drying period which for convenience has been referred to as the period E. The drying period E is 15.5 minutes during which time heated air is continuously delivered by the fan 150 and heating element 151. The drying period commences at 14.5 minutes into the steaming and drying cycle and lasts until the end of the steaming and drying cycle. During this period, only heated air is delivered into the interior 28 of the cabinet 1.

The steaming period D is 10 minutes and commences approximately 4.5 minutes into the cycle and lasts until 14.5 minutes into the cycle. In other words, the steaming period D terminates just as the drying period E commences. Graph G of FIG. 14 illustrates the time period during which the fan 151 and heating element 150 introduce heated air into the interior region 28. Graph J of FIG. 14 illustrates the time period during which steam is continuously delivered into the interior region 28. In both cases, the cross hatched sections are the periods of time during which the heated air and steam are being delivered. As can be seen from FIG. 14 heated air is also delivered into the interior region of the cabinet simultaneously with the steam during the steaming period D. During this period the heated air is intermittently delivered for four 1 minute intervals during the steaming period D. The first 1 minute interval commences at 4.5 minutes into the cycle and ceases at 5.5 minutes into the cycle. The next interval during which heated air is introduced commences at 7 minutes and lasts 1 minute, terminating at 8 minutes. The last two intervals during which heated air is introduced during the steaming period commence and terminate respectively at 9.5 and 10.5 and 12 and 13 minutes into the cycle.

Since the heated air is delivered by the heating element 150 and motor operated fan 151 and the heated air commences delivery and ceases delivery on switching on and switching off of the element 150 and fan 151, the graph G of FIG. 14 effectively illustrates the on periods of the cam switch **173*b* which activates the fan 151 and heating element 150. The graph H in FIG. 14 illustrates the time period during which the cam operated switch 173*a* is closed, in other words the period of time during which the heating element 166 is on. Because the water in the tank 165 takes some time to boil, the heating element 166 is on for a longer period than the steaming period, in other words, the element 166 is on for the period F, which in this case is the first 14.5 minutes of the steaming and drying cycle. In general, it has been found that the water in the tank 165 boils at 4.5 minutes and thus the steaming period D commences at 4.5 minutes. However, it will be appreciated by those skilled in the art that the time for the water to boil will depend on the quantity of water in the tank 165, thus when the tank is full it will take slightly longer for the water to boil, and thus the steaming period may not commence for six minutes after the heating element 166** has been switched on, while on the other hand when the water level in the boiler is relatively low, the boiler may commence boiling at 3 minutes into the cycle.

In the present case, where the steam is continuously introduced from 4.5 to 14.5 minutes of the cycle, the heated air is introduced simultaneously with the steam for approximately 40% of the steaming period. It will be appreciated that where the water boils at 3 minutes, the steaming period will be slightly longer, in other words, it will last for 11.5 minutes. In this case, the heated air will be introduced simultaneously with the steam for approximately 35% of the steaming period. On the other hand, where the water does not commence to boil until 6 minutes into the steaming and drying cycle, the steaming period would only last 8.5 minutes. The heated air would only be introduced simultaneously with the steam for three intermittent intervals. Thus, the heated air would be introduced for approximately 47% of the steaming period. In this latter case, the heated air will still be introduced into the interior region of the cabinet for the interval from 4.5 to 5.5 minutes into the cycle. It has been found that the introduction of this heated air at this time heats up the interior region of the cabinet prior to introduction of steam, and this helps in keeping the level of condensation formed on the inner surface of the interior region at its low level.

It has been found that by introducing heated air simultaneously with the steam during the steaming portion that the amount of condensation formed on the inner surface of the interior region of the cabinet 1 and the interior region 28 is kept to a level where droplets do not form. This thus avoids any danger of condensation droplets falling from the inner surface onto the clothes. In fact, it has also been found that where heated air is introduced simultaneously with the steam for a time period in the range of 35% to 47% of the steaming period the level of condensation is held to a level where droplets do not form. Furthermore, within this range the effectiveness of the steam in removing wrinkles is not impaired to any appreciable extent. However, it is believed that optimum results are achieved when the heated air is introduced simultaneously with the steam for approximately 40% of the steaming period. It is, however, also believed that adequate results could be achieved where heated air is introduced simultaneously with the steam for only 10% of the steaming period. It is believed that at this level the condensation will still be kept to a level where water droplets do not form, and the effectiveness of the steam in removing wrinkles will remain virtually unaffected.

It has further been found that best results are achieved by introducing the heated air intermittently during the steaming period rather than during one continuous long interval. It has been found that by intermittently introducing the steam, the effectiveness of the steam in removing wrinkles is less impaired, and there is less opportunity for condensation to build up to a level where droplets would form.

In this case, the volume of the interior region 28 of the cabinet is approximately 99,000 cc. The heating element 150 is a 660 watt heating element. The capacity of the fan 151 is 45 $m^3$ per hour. The heating element 166 is a 1,000 watt heating element and the capacity of the boiler tank 165 is 1.5 L. The area of the outlet 175 from the interior region 28 is 50 $cm^2$ and the area of the exhaust outlet 177 through the top wall 9 is 25 $cm^2$, thus giving an area ratio of 2:1.

The area of the make up air inlet 179 is 78 $cm^2$. This has been found to match adequately with the outlets 175 and 177.

It has been found that with the size of the interior region of the cabinet and the other components sized as just described, an operating temperature of approximately 60° C. is achieved within the interior region of the cabinet during the steaming portion of the cycle and an operating temperature of 60° C. is achieved during the drying portion of the cycle. Thus, the air is heated to approximately 60° C. by the heating element 150 during both the steaming and drying periods of the cycle.

An electrically powered fan heater unit 204 mounted in the sub housing 33 delivers heated air through a flexible hose 201 to an air delivery nozzle 200 for hairdrying, handdrying and the like. A tubular duct 206 extending through the side wall 37 of the sub housing 33 and the side wall 8 of the outer skin 1 connects the fan heater unit 204 to the hose 201. The fan heater unit 204 is of the type normally used in hairdriers and will be well known to those skilled in the art. Air is drawn in by the fan heater unit 204 through openings 212 and 213 in the side walls 8 and 37. The switch **76*c* operates the fan heater unit 204 through a circuit (not shown). The circuit is in the control box 161 and is independent of the circuit for the heating elements 150, 166 and the fan 151. A partition wall 218 extending between the front and rear walls 38 and 39 and the bottom member 35 and top wall 40 sealably divide the housing to prevent steam being drawn in by the fan heater unit 204. A holder 219 on the side wall 8 supports the nozzle 200** when not in use.

A bracket 224 on the rear wall 6 of the housing 4 is provided for mounting the cabinet 1 to a wall by engaging a corresponding receiving bracket (not shown).

In use, the boiler tank 165 is filled with water. Garments to be steamed and dried are placed in the interior region 28 of the cabinet 1 as illustrated in FIG. 4. For example, jackets 136 and the like are hung on the hangers 135 while trousers 107 or other similar type garments are hung on the bars 109 in the door 5. The weighted bars 146 and 147 are clipped on to the bottom edge of the suit jacket and the ends of the sleeves respectively. The waist of the trousers is clamped against the front wall of the door by the clamp bar 110. The weighted bar 119 is raised and engaged on the hooks 129 and clipped on to the ends of the trousers 107. The weighted bar 119 is then removed from the hooks 129 and allowed to suspend from the trouser ends, thereby tensioning the trousers 127. The door 5 is closed and the switch **76*a* is activated. This activates the timer 171 which operates the steaming and drying cycle as already described with reference to FIG. 13. When the steaming and drying cycle has been completed, the door 5** is opened and the clothes removed.

It has been found that by putting the garments in tension by use of the weighted bars 119, 143 and 146 the removal of wrinkles from the garments during the steaming cycle is considerably enhanced and also accelerated.

While a particular steaming and drying cycle have been described, other steaming and drying cycles could be used without departing from the scope of the invention. It will of course be appreciated that while it is preferable it is not essential that the heated air should be intermittently delivered into the interior region during the steaming period.

While in this particular embodiment of the invention, the drying period has been described as commencing immediately after the end of the steaming cycle this is not essential in certain cases it is envisaged a pause may be provided between the steaming and drying cycle during which nothing would be delivered into the interior region. While the operating temperature of the air and steam mixture has been described as being heated to 60° C., adequate results would be achieved with an operating temperature in the range of 35° C. to 85° C. It is also envisaged that air operating temperatures during the drying period of the cycle in the range of 35° C. to 85° C. would produce adequate results. However, in both cases it is preferable that the temperature in the interior region of the cabinet should be at least 50° C. Furthermore, adequate results would be achieved once the air is heated to a temperature in the range of 35° C. to 85° C. during the steaming period of the cycle.

While the cabinet has been described as being of a particular interior volume, cabinets of other volume could be used without departing from the scope of the invention. Furthermore, heating elements for heating the air and water of other capacities could be used, as could be fans of other capacity for circulating the air. While the heated air has been described as being introduced into the interior portion for approximately 40% of the total time of the steaming period, the period of time during which the heated air is introduced during the steaming period could be considerably greater or considerably less without departing from the scope of the invention. In fact, it is envisaged that adequate results would be achieved once heated air was introduced for a period of time which was at least 10% of the steaming period. In fact, in certain cases, it is envisaged that the heated air could be introduced during the entire period of the steaming period.

Further, while the ratio of the areas of the outlet from the interior region and the exhaust outlet has been described as being 2:1, it is envisaged that adequate results would be achieved once the ratio of the areas of the interior region outlet and the exhaust outlet is maintained within the range of 1.5:1 to 2.5:1.

Further, it will be appreciated that steaming and drying cycles of other durations with steaming periods and drying periods of other durations could be provided without departing from the scope of the invention. Needless to say, it is not essential for the steaming and drying periods to be of similar time spans, the steaming period may be of time span greater or lesser than the drying period.

Further, it is envisaged that while the cabinet has been described for steaming and drying clothes, it could also be used for drying and/or airing clothes, in which case the steam part of the cycle would not be used. In fact, it is envisaged that the cabinet would be used to air the garments after the steaming and drying cycle, should the garments be of the type which require a considerable lengthy drying and airing period. In which case, it is envisaged that the heated air would be delivered for a further continuous period and in certain cases it is envisaged that the air may be delivered intermittently during an airing cycle.

Needless to say, other garments could be steamed and dried and indeed aired in the cabinet, such as, for example, skirts, blouses, dresses, coats, underwear and the like.

It will of course be appreciated that while the cabinet has been described as comprising a hairdryer, this could be dispensed with if desired. It will also be appreciated that where a hairdryer is desired, in certain cases it is envisaged that the hairdryer may receive heated air from the fan 151 and heating element 150, however, in such a case it will be appreciated that the boiler tank would be deactivated during hair drying.

It will also be appreciated that in certain cases the duct for recirculating the air and/or steam may be dispensed with, or where recirculation is required other suitable ducting means could be used without departing from the scope of the invention. Needless to say, other suitable or desirable or constructions of housing could be used without departing from the scope of the invention.

It is also envisaged that other tensioning means besides those described could be used. Indeed, instead of using weighted bars, other suitable weighted members could be used, and indeed in certain cases it is envisaged that tensioning means which would include spring tensioning could be used similarly without departing from the scope of the invention. Needless to say weights of values other than those described may be used without departing from the scope of the invention. To some extent, the value of the weights may depend on the garment being steamed, and it is envisaged that means for varying the value of the weights may be provided.

It is also envisaged that an air freshening medium may be provided in a suitable location in the housing, for example, the medium may be provided in the interior region or it may be provided in the duct 152. Such air freshening mediums will be well known to those skilled in the art, and in general they would be suitable for freshening the garments.

It will also be appreciated that while the air heating means has been described as being provided by an electric heating element 150 and an electrically powered motor driven fan has been used for circulating the air, other suitable air heating and circulating means could be used.

It will also be appreciated that other suitable steam generating means besides a boiler tank with an electrically powered immersion heater could be used. In certain cases it is envisaged that gas powering could be used. Further, it is envisaged that instead of generating the steam in a boiler tank, the steam could be generated by drip feeding water onto a heated plate. It is also envisaged in certain cases that the cabinet could be plumbed directly into a water supply and the level of water in the tank or to be drip fed onto the heated plate could be controlled by a ball valve. In general, where the steam is to be generated by a drip feed of water onto a heated plate, it is envisaged that a reservoir to store the water would be provided and a suitable outlet means to provide drops as required would be provided from the reservoir.

It will of course be appreciated that any other construction of duct for delivering heated air into the interior region of the cabinet could be used and indeed, in certain cases the cowl member may be dispensed with, although it has been found that using the cowl member is particularly advantageous in that it facilitates distribution of the heated air more evenly throughout the cabinet, and additionally, the edge portions of the cowl may be bent upwardly or downwardly to fine tune the distribution of the air throughout the cabinet. Needless to say, it will be appreciated that in general such fine tuning would be done at the factory prior to dispatch of the unit.

It is also envisaged that an air filter may be provided in the inlet grill 179.

It is also envisaged that the cabinet may be provided with a steaming cycle only, in which case the drying period of the cycle would be omitted. It is further envisaged that in certain cases the cabinet may be provided for drying clothes only, in which case the steaming period of the cycle would be omitted, and indeed the means to generate steam would also be omitted from the cabinet.

While the cabinet has been described as requiring a 220 volt AC supply, it could operate on any power supply, whether AC or DC and of any voltage. For example, in many cases it is envisaged that it may operate on 110 volts.

Further, it is envisaged that the cabinet may be sized and shaped to accommodate other garments, for example, full length coats, dresses and the like. Indeed, in certain cases it is envisaged that where the cabinet is mounted at a relatively high location on a wall, a suitable loading device may be provided for raising the clothes on the hangers to a height where the hangers can engage the support bracket.

It is also envisaged in certain cases that suitable moisture absorbing apparatus may be provided on the exhaust outlet to further absorb moisture from the air prior to being exhausted. Such moisture absorbing apparatus could be provided in the form of a condenser or the like. In fact, where a condenser is used, the moisture collected by the condenser could be directed to the drip tank.

While not described, it will be readily appreciated by those skilled in the art that suitable safety control mechanisms will be provided, for example a thermostat will be provided in the boiler to avoid any danger of the boiler tank boiling dry. Further, it is envisaged that a suitable relay will be provided which will be interlocked with the door, so that on opening of the door during a steaming and drying cycle, the apparatus will be deactivated. Other suitable safety and interlocking devices may be provided as desired. Indeed, it will be appreciated that in certain cases a moisture sensor may be provided to monitor the moisture being removed on the drying cycle so that on a garment being dried, the moisture sensor would deactivate the apparatus, thereby terminating the drying cycle. It is also envisaged in certain cases that the air which is simultaneously introduced into the interior region of the cabinet during the steaming period of the cycle could be activated in response to such a moisture sensor or indeed any other suitable monitoring devices to monitor when steam has actually commenced delivery into the cabinet. Needless to say, in certain cases it is envisaged that the drying cycle may also be activated by a sensor in the cabinet rather than being activated by a timer.

It will of course be appreciated that any other clamping means or arrangement could be used for clamping the tensioning means to the clothes and clamping the clothes to the cabinet.

It is also envisaged that a shaving socket for powering an electric razor may be provided at a suitable location in the cabinet, for example, adjacent the strip light on the door. The transformer and other control apparatus for the socket may be provided in the sub housing adjacent the control box 161.

It is further envisaged that a recess may be provided in the member 68 to receive a chemical which may be provided in liquid, powder or solid form to add fragrance to the clothes during the steaming and drying cycle.

It is also envisaged that an outlet from the boiler will be provided to enable hot or boiling water to be drawn off for other purposes, for example making tea or coffee.

We claim:

1. A clothes steaming and drying cabinet comprising:

a main housing defining an enclosed interior region for receiving clothes, steam delivery means for delivering steam into the interior region during a steaming period of a steaming and drying cycle, air delivery means for delivering heated air into the interior region during part of the steaming and drying cycle, and control means for controlling the steam delivery means and the air delivery means for delivering steam continuously into the interior region during the said steaming period of the steaming and drying cycle, and for intermittently delivering heated air into the interior region simultaneously with the steam during part of the said steaming period of the steaming and drying cycle.

2. A cabinet as claimed in claim 1 in which the control means controls the air delivering means for intermittently delivering heated air simultaneously with the steam into the interior region for at least 10% of the said steaming period of the steaming and drying cycle.

3. A cabinet as claimed in claim 1 in which tensioning means for tensioning a garment is provided in the interior region.

4. A cabinet as claimed in claim 3 in which the tensioning means is provided by a weight member having clip means attached thereto for releasably connecting the weight member to the garment.

5. A cabinet as claimed in claim 1 in which recirculating means is provided for recirculating some of the heated air and steam from an outlet from the interior region into an inlet to the interior region, a make up air inlet communicating with atmosphere for providing make up air to the interior region is provided.

6. A cabinet as claimed in claim 5 in which the recirculating means comprises a duct extending from the outlet from the interior region, an exhaust outlet in the duct communicating with atmosphere for exhausting some of the heated air and steam and/or moisture to atmosphere, the interior region outlet and the exhaust outlet being substantially opposite each other, the ratio of the effective area of the interior region outlet to that of the exhaust outlet being at least 1.5:1.

7. A clothes steaming and drying cabinet as claimed in claim 1 in which means are provided for delivering heated air through a nozzle mounted externally of the housing for drying hair or the like.

8. A method for steaming and drying a garment in an interior region of a cabinet, the method comprising the steps of delivering steam continuously into the interior region of the cabinet during a steaming period of a steaming and drying cycle, delivering heated air into the interior region of the cabinet during at least part of the steaming and drying cycle, wherein the heated air is intermittently delivered into the interior region simultaneously with the steam during part of the said steaming period of the steaming and drying cycle.

9. A method as claimed in claim 8 in which the heated air is intermittently delivered simultaneously with the steam into the interior region for at least 10% of the said steaming period of the steaming and drying cycle.

10. A method as claimed in claim 8 in which the steaming and drying cycle comprises the said steaming period and a drying period, the steaming period being at least 20% of the total steaming and drying cycle time, and the drying period being at least 20% of the total steaming and drying cycle time.

11. A clothes steaming cabinet comprising:

a main housing defining an enclosed interior region for receiving clothes, steam delivery means for delivering steam into the interior region during a steaming period of a steaming cycle, air delivery means for delivering heated air into the interior region during part of the steaming period of the steaming cycle, and control means for controlling the steam delivery means and the air delivery means for delivering steam continuously into the interior region during the steaming period of the steaming cycle, and for intermittently delivering heated air into the interior region simultaneously with the steam during part of the said steaming period of the steaming cycle.

* * * * *